United States Patent [19]

Newman et al.

[11] 4,092,456

[45] May 30, 1978

[54] TRANSFER ELEMENTS AND PROCESS

[75] Inventors: Douglas A. Newman; Allan T. Schlotzhauer, both of Glen Cove, N.Y.

[73] Assignee: Columbia Ribbon & Carbon Mfg. Co., Inc., Glen Cove, N.Y.

[21] Appl. No.: 540,086

[22] Filed: Jan. 10, 1975

Related U.S. Application Data

[63] Continuation-in-part of Ser. No. 360,334, May 14, 1973, Pat. No. 4,042,744, and a continuation-in-part of Ser. No. 213,534, Dec. 29, 1971, abandoned.

[51] Int. Cl.[2] ..... B41C 1/06

[52] U.S. Cl. ..... 428/307; 427/152; 427/153; 427/352; 427/373; 428/914

[58] Field of Search ..... 427/153, 245, 244, 243, 427/141, 152, 352, 373; 428/306, 914, 307

[56] References Cited

U.S. PATENT DOCUMENTS

| | | | |
|---|---|---|---|
| 2,759,586 | 1/1953 | Juengerkes | 427/153 X |
| 2,777,824 | 12/1957 | Leeds | 260/2.5 |
| 3,105,769 | 10/1963 | Ellerin | 427/141 |
| 3,442,680 | 5/1969 | Newman | 428/914 X |
| 3,442,681 | 5/1969 | Newman et al. | 428/914 X |
| 3,484,268 | 12/1969 | Newman | 427/153 X |
| 3,524,753 | 8/1970 | Sharp | 260/2.5 X |

*Primary Examiner*—Ralph S. Kendall
*Attorney, Agent, or Firm*—Thomas L. Tully

[57] ABSTRACT

Transfer elements for exuding liquid ink to a copy sheet under the effects of imaging pressure, and the method of making such transfer elements. A resinous solvent composition comprising a blowing agent and a soluble solid is applied to a coating surface, the blowing agent is activated and the soluble solid is dissolved out to form a porous resinous layer which is thereafter impregnated with a pressure-exudable liquid duplicating ink.

10 Claims, 3 Drawing Figures

TRANSFER ELEMENTS AND PROCESS

Figure 1:
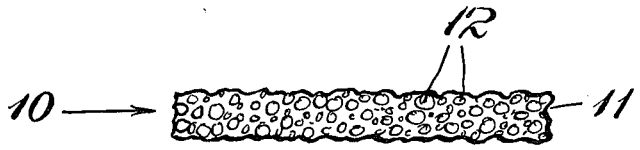

The present application is a continuation-in-part of copending application Ser. No. 360,334, filed on May 14, 1973, now U.S. Pat. No. 4,042,744, and is a continuation-in-part of Ser. No. 213,534, filed Dec. 12, 1971, abandoned.

The present invention relates to the production of inkable transfer elements such as carbon papers, typewriter ribbons, inking rollers and other pressure-sensitive, ink-releasing elements from volatile solvent compositions based upon resinous film-forming binder materials.

Squeeze-out type transfer elements are conventionally produced by preparing a solution or plastisol dispersion of a resinous binder material, an incompatible oil and coloring matter in a volatile solvent or non-volatile plasticizer, applying the composition to a foundation as a thin layer and evaporating the solvent or heating to an elevated temperature and then cooling to form an imaging layer comprising a non-transferable fine interconnected porous network of the resinous binder material having formed in situ within the micropores thereof a multiplicity of pressure-exudable ink droplets consisting of the oil and coloring matter.

Such conventional transfer elements have certain limitations and disadvantages arising from the method of their manufacture. The porous network of resinous binder material is exceptionally fine and therefore is relatively weak and subject to breakdown and transfer under imaging pressure. The oily ink vehicle must be substantially incompatible with the resinous binder material at ordinary room temperatures in order for pore-formation to occur and this precludes the use of certain plasticizing oils such as tricresyl phosphate which have advantageous properties with respect to the imaging of planographic printing plates. Conversely, the use of certain resinous binders is precluded by their compatibility with oily materials and/or their inability to form a microporous layer with an oil when deposited from a volatile solvent or as a plastisol dispersion.

It has been proposed to produce inkable porous resinous layers, coatings or masses from volatile solvent compositions through the use of finely-divided soluble solid materials such as water-soluble salts which are present in the solvent composition and are distributed in the solidified layer, coating or mass. After solidification, the layer, coating or mass is washed with a solvent for the soluble solid, which is a non-solvent for the resinous binder material, to remove the soluble solid and leave empty pockets or pores in the resinous binder material. Thereafter the porous resinous structure is impregnated with liquid ink to form an element capable of releasing the ink in metered amounts to a succession of copy sheets.

The principal problem encountered with this soluble salt process is the inability of the leaching solvent to contact solid particles which are trapped in the interior of the resinous mass and are encased within the resinous binder material which is not soluble in the leaching solvent.

It has also been proposed to produce inkable porous resinous layers, coatings or masses from volatile solvent compositions through the use of heat-activatable blowing agents which are materials which react or decompose on heating to liberate a gas. Such materials generally result in the formation of closed cells within the resinous structure, with little or no interconnection between the cells. Resinous porous bodies of this type cannot absorb ink into the closed cells and thus generally absorb only a limited amount of ink into the cells which are open adjacent the surface of the coating, layer or mass.

It is the principal object of the present invention to provide a new method for producing squeeze-out type transfer elements from solvent resinous compositions which avoids the disadvantages and limitations of prior known methods and provides transfer elements having improved properties of strength, ink capacity and performance.

It is another object of this invention to provide squeeze-out type transfer elements by solvent-coating techniques which can be re-inked continuously or as often as desired to provide a continuous ink supply in a duplicating machine such as a typewriter.

Figure 2:
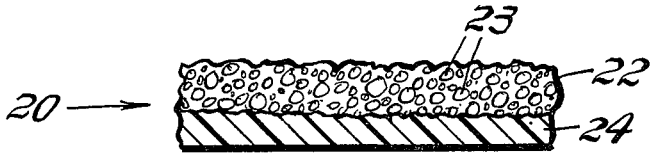
Figure 3:
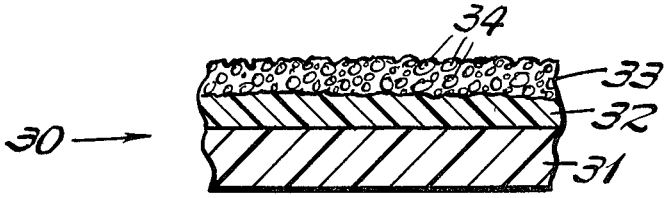

These and other objects and advantages of this invention will be apparent to those skilled in the art in the light of the present disclosure including the drawing, in which:

FIGS. 1, 2 and 3 are diagrammatic cross-sections, to an enlarged scale, of pressure-sensitive, squeeze-out type transfer elements produced according to the present invention.

The present invention involves the discovery that improved squeeze-out type transfer elements can be produced by applying to a support such as a casting surface or a flexible foundation such as a plastic film a resinous composition comprising a resinous film-forming binder material, a quantity of a finely-divided particulate soluble solid, a quantity of a finely-divided, particulate, heat-activatable, solid blowing agent and a volatile solvent for said binder material which is a non-solvent for said soluble solid and for said blowing agent, evaporating said volatile solvent to form a solidified resinous layer, coating or mass, heating said solidified body to the activation temperature of said blowing agent to cause pore-formation thereby, and treating the porous, resinous body with a liquid which is a solvent for said soluble solid but a non-solvent for the binder material to dissolve and remove the soluble solid and form an interconnected microporous network of the synthetic film-forming binder material having the desired strength, pore size and interconnected pore content. Thereafter the microporous resinous network is impregnated with a liquid ink comprising non-drying oil and coloring matter. The formation of the microporous resin network, independent of the oily ink, permits the use of a wide range of resins and the formation of the desired interconnected pore structure to suit the intended end use of the transfer element. Also the ink-free resin network may be cured or otherwise strengthened and may be stored for any length of time prior to impregnation with ink.

The transfer elements produced according to the present invention may be self-supporting, as shown by FIG. 1, or may have a preformed synthetic thermoplastic film foundation which has the strength and flexibility required of transfer elements such as typewriter ribbons and which is inert with respect to the composition applied thereto, particularly the solvent or liquid vehicle thereof, as shown by FIGS. 2 and 3. Preferred films include thin polyethylene terephthalate polyester, polypropylene, nylon, cellulose acetate, and the like. Onto this film is applied a thin coating of synthetic thermoplastic resin containing the soluble solid and blowing agent pore-forming materials which, when removed, leave the coating containing a multiplicity of empty, interconnected pores which absorb liquid ink and which cause the distribution of such ink throughout the coating by means of capillary action. The size, number and distribution of the pores formed in the coating can be predetermined by selecting the proper amount of the proper pore-forming materials having the desired particle size.

In some cases, where increased durability is desirable, it is preferred to provide a thin intermediate bonding layer between the film foundation and the pore-forming layer, as illustrated by FIG. 3 of the drawing, the bonding layer comprising a continuous layer of a synthetic thermoplastic resin which may be inert with respect to the pore-forming composition, particularly the volatile solvent or liquid vehicle thereof, or may be soluble in said solvent or liquid vehicle so as to become solvent-bonded to the pore-forming layer.

Referring to the drawing, FIG. 1 illustrates a self-supporting transfer element 10 comprising a microporous resinous structure 11 containing a multiplicity of interconnected pores 12 impregnated with pressure-exudable liquid ink.

FIG. 2 illustrates a supported transfer element 20 comprising a film foundation 21 having bonded thereto a porous layer 22 of synthetic thermoplastic resin containing interconnected pores 23 impregnated with pressure-exudable liquid ink.

FIG. 3 illustrates a supported transfer element 30 comprising a film foundation 31, an intermediate bonding layer 32 of synthetic thermoplastic resin and a porous layer 33 of synthetic thermoplastic resin containing interconnected pores 34 impregnated with pressure-exudable liquid ink.

The synthetic resinous or film-forming binder material for the pore-forming layer is preferably a resin being capable of forming a thin film having high impact strength and cut-resistance with respect to a type face. Substantially any film-forming synthetic resin is suitable, particuarly in association with a preformed film foundation, including vinyl resins such as vinyl chloride-vinyl acetate copolymers and acrylic polymers, cellulosic polymers such as cellulose acetate-butyrate, nylon polyamides, polyurethanes, polycarbons, and the like.

Preferably the pore-forming coating, layer or mass is applied as a blushed coating containing the resin and the solid pore-forming materials in order to facilitate the removal of the pore-forming materials by vaporization and dissolution. Blushed coatings are formed in known manner through the use of a mixture of volatile liquids, one of which is more volatile than the other and is a solvent for the synthetic thermoplastic resin, while the other less volatile liquid is a non-solvent for the resin. Neither volatile liquid is a solvent for the pore-forming materials. The evaporation of the solvent leaves the volatile non-solvent as a liquid pore-forming material dispersed throughout the coating and the eventual evaporation of the non-solvent leaves empty, interconnected micropores in the resinous coating. The subsequent removal of the solid pore-forming materials is facilitated by the presence of these micropores.

The inks used according to the present invention may be conventional liquid non-drying duplicating inks comprising an oily vehicle, which is substantially incompatible with the porous resinous network, and pigment or dyestuff. Suitable oils are the animal, vegetable and mineral oils as well as synthetic oils such as organic esters including tricresyl phosphate, dioctyl phthalate and the like, depending upon the identity of the resin network. Preferably the ink includes a wetting agent and a volatile solvent or diluent in order to facilitate the complete penetration of the ink into the porous coating. Any such solvent or diluent is evaporated after the coating is inked and must be a non-solvent for the resinous network.

The essential pore-forming materials suitable for use according to the present invention are solid, finely-divided, particulate materials which are insoluble in the coating solvent and incompatible with and capable of being uniformly dispersed throughout the synthetic thermoplastic resin binder and capable of being selectively removed from the coating formed therefrom by means of heat and volatile solvent respectively to provide the interconnected porous resin mass which is receptive to the liquid duplicating ink.

The first type of solid pore-forming material, namely the blowing agent, comprises one or more materials which react or decompose to form a gas under the effects of heating to a temperature which is higher than the solidification temperature of the layer, i.e. higher than the evaporation temperature of the coating solvent, and which is not so high as to adversely affect the resinous network or its film foundation, if one is present. Materials of this type include the conventional blowing agents which decompose to liberate a safe gas such as nitrogen, nitrogen oxide, carbon dioxide, or the like. Illustrative materials include solid organic compounds such as N, N-dinitroso pentamethylene tetramine, N, N'-dimethyl-N, N'-dinitroso terephthalamide, p, p'-oxybis (benzene sulfonly hydrazide) and diazoaminobenzene and inorganic compounds such as sodium carbonate and ammonium bicarbonate.

Another type of suitable pore-forming blowing agent materials comprises solids which sublime at a temperature which is greater than the solidification temperature of the layer and is not detrimental to the resinous network or its film foundation. Materials of this type include sublimable solids such as salicylic acid, chlorobenzoic acid, camphor, and the like.

Suitable soluble or leachable solid pore-forming materials comprise solids which can be selectively dissolved from the resinous coating by means of a volatile solvent which is a non-solvent for the resinous binder of the coating. Preferred materials are the inorganic salts which are soluble in water and/or mixtures of water and alcohols such as methanol and ethanol. Such materials include alkali metal- and alkaline earth metal-chlorides, sulphates, nitrates, carbonates, and the like.

The amounts of the blowing agents and soluble salts used and the particle size thereof may be varied widely within limits in order to produce the desired type of porous resinous network. Generally the weight ratio of the blowing agent pore-forming material to the synthetic thermoplastic resin in which it is dispersed will be from 0.1:1 to about 3:1, and the average particle size of solid pore-forming material will range between about 1 and 10 microns, the larger sizes within the range being suitable for use in thicker layers or masses. In the case of the soluble pore-forming materials, these preferably are used in amounts at least equal to the weight of the resin and up to about five times the weight of the resin and may have a particle size of from 5 to 50 microns.

Generally it is preferred to employ at least twice as much of the soluble, leachable pore-former than the blowing agent and to use smaller particles of the latter in combination with larger particles of the former. This is so because the conversion of the blowing agent from solid to gas form substantially increases the volume thereof and results in a "puffing" of the resinous mass and a tearing and weakening of the resinous structure. The removal of the leachable solid does not produce such stresses since the empty pore space produced thereby is of the same volume as the space occupied by the solid before dissolution. Thus it is preferred to use at least about twice as much of the soluble solid as the blowing agent and to use particles of the former which have an average size which is at least twice as great as the average particle size of the latter. Also, it is noted that the mere presence of the soluble solid pore-former in the resinous mass facilitates the escape of the activated blowing agent by disrupting the continuity of the resinous mass and providing weak adhesion interfaces between the soluble solid and the resinous material, whereby the gasified blowing agent is better able to escape from the resinous mass.

In the case of carbon papers and ribbons, the porous coatings of the present invention preferably have a thickness of from about 0.5 to 2 mils and are produced by preparing a solution or dispersion of a synthetic thermoplastic resinous film-forming material in a liquid vehicle, dispersing into said solution or dispersion suitable amounts of the blowing agent and soluble solid pore-forming materials, applying the composition to a casting surface, or to a film foundation, or to a resinous binder layer thereon, in the form of a thin coating and solidifying the coating by evaporating the volatile vehicle.

Next, the coating is treated to activate and selectively remove the blowing agent from the surface and from underlying portions of the coating. This is accomplished by applying heat to the coating and preselecting the temperature and/or duration of the heating in order to drive off as much of the blowing agent as possible without puffing the coating to such an extent as to cause excessive damage to the resinous structure. Most blowing agents decompose to form safe gases such as nitrogen oxide, carbon dioxide, ammonia, or the like, which remains in the pores until displaced by air and/or by the liquid ink in the inking step.

Next, the coating is washed such as by immersion in a volatile liquid which is a solvent for the soluble solid pore-former remaining in the resinous mass but is a non-solvent for the resin itself. The partial porosity of the resinous mass, caused by the activation of the blowing agent, permits the washing solvent to penetrate within the resinous mass to a substantially greater extent than possible with resinous masses produced in the absence of the blowing agent, whereby removal of the soluble solid is substantially complete. The washing step may be accompanied by the use of wetting agents to facilitate penetration and agitation and/or squeezing of the resinous mass to assist in the dissolution of the soluble solid.

Thereafter the porous resinous mass is heated to evaporate the washing liquid and, if desired, the drying temperature may be sufficiently high to activate any residual blowing agent which has not been removed by the washing step and which could not be removed in the initial heat-activation step.

Finally, the formed porous coating is impregnated with liquid duplicating ink comprising oil and colorant and the final element, having a thickness of from about 1 to 4 mils, is cut into sheet lengths or ribbon widths.

The following examples are given by way of illustration and should not be considered to be limitative.

Example 1

A pore-forming coating composition is prepared by uniformly dispersing 5 parts by weight of ammonium carbonate and 30 parts by weight of sodium chloride in a solution comprising 15 parts by weight of alcohol-soluble nylon polyamide in 85 parts by weight of ethanol.

The solution is coated onto a foundation of 0.5 mil polyethylene terephthalate (Mylar) and the ethanol is evaporated to form a pore-forming coating having a thickness of about 0.5 mil.

The coated Mylar is then heated by applying hot air to the pore-forming coating to raise the temperature of the coating to about 70° C to decompose the ammonium carbonate and evolve ammonia and carbon dioxide gases, leaving the spaces previously occupied by the ammonium carbonate empty. Heating is continued until all of the ammonium carbonate is decomposed, leaving the nylon coating porous throughout. Thereafter the Mylar film carrying the porous nylon layer is washed with warm water to dissolve out the sodium chloride particles and substantially increase the porosity of the nylon layer. This may be accomplished by submerging the coated film in warm water and passing it through a series of submerged pressure rollers which squeeze the coating to express the dissolved salt and to absorb additional water solvent. Next, the washed element is dried thoroughly by heating in forced hot air to remove the water from the porous network.

Referring to FIG. 2 of the drawing, the formed porous nylon coating 22 on the Mylar film foundation 21 contains empty pores 23 and the transfer element 20 is ready for inking.

Finally, the porous nylon layer is impregnated with a 50% solution of a conventional liquid duplicating ink comprising mineral oil, butyl stearate and carbon black pigment in a volatile solvent which is a non-solvent for the porous nylon network, such as mineral spirits. The ink solution is left on the porous surface of the nylon layer for several minutes to allow for absorption thereof by capillary action and then heat is applied to evaporate the ink solvent. Inking may be repeated if necessary after the initial ink has penetrated into the coating pores.

The formed transfer element has excellent strength and imaging properties and the porous ink layer may be re-inked after the initial ink supply is depleted.

Example 2

A continuous web of 0.5 mil Mylar may be coated on one surface with a thin layer of the following resinous composition:

| Ingredients | Parts by Weight |
|---|---|
| Vinyl chloride-vinyl acetate copolymer | 20 |
| Sodium chloride (granulated) | 60 |
| N,N'-dimethyl, N,N' dinitroso terephthalamide | 1 |
| Methyl ethyl ketone | 80 |
| Heptane | 30 |

The composition is heated to 80° C to evaporate the ketone solvent and leave the heptane non-solvent dispersed in droplet form throughout the coating which also contains the sodium chloride particles and terephthalamide uniformly dispersed throughout.

Next the temperature is raised to 100° C to evaporate the heptane and provide a blushed porous resin layer. The temperature is increased to 120° C to cause the terephthalamide blowing agent to decompose and release a nitrogen gas, producing further porosity within the layer.

Finally the porous layer may be washed with water to dissolve out the sodium chloride particles and provide a vinyl resin layer having a high degree of interconnected porosity. The porosity caused by the evaporation of the heptane and decomposition of the blowing agent facilitates the dissolving out of the salt particles. Finally the porous web is heated to remove the water and form a dry porous coating of the Mylar film foundation.

To produce bicolor typewriter ribbons, the porous web may be cut into ribbon widths while simultaneously rolling a dull heated disc roller down the middle of the porous layer to fuse the porous vinyl resin layer and destroy its porosity without cutting or weakening the Mylar support, thus producing a non-porous barrier strip which cannot absorb the liquid ink with which the porous coating is impregnated. Thereafter liquid inks of different colors, such as black and red, are applied to opposite sides of the barrier strip in the manner discussed in Example 1.

Example 2 incorporates three means for producing porous resin coatings useful according to the present invention, namely the use of a volatile liquid which is less volatile than the volatile solvent for the resin and which itself is a non-solvent for the resin, the use of a conventional solid blowing agent which decomposes and liberates a gas, when heated, and a solid which is leachable by means of a solvent which is a non-solvent for the resin.

While the present transfer elements are preferably produced by forming the microporous resin layer on a flexible film such as Mylar, polypropylene, cellulose acetate or other foundation, such as paper, which is retained as a support for the transfer element, it is also possible to produce the microporous resin layer on a casting surface and to remove the layer for subsequent inking and use as a self-supporting transfer element, as illustrated by FIG. 1 of the drawing. A resinous coating may be applied to one surface to provide a sealing layer, if desired.

Variations and modifications may be made within the scope of the claims and portions of the improvements may be used without others.

We claim:

1. Process for producing a liquid ink-releasing transfer element comprising the steps of:

(a) preparing a composition consisting essentially of a synthetic film-forming binder material, a volatile solvent for said binder material, a particulate heat-activatable solid blowing agent and a particulate solid which is soluble in a volatile solvent which is a non-solvent for said binder material, said blowing agent and particulate solid being insoluble in said solvent for said binder material and said particulate solid being present in a larger amount by weight than said blowing agent;

(b) depositing said composition and evaporating said volatile solvent to form a solidified mass of said binder material containing said blowing agent and said particulate solid;

(c) heating said solidified mass to activate said blowing agent and liberate a gas to form gas-containing pores within said mass, some of said liberated gas being permitted to escape from said layer due to the presence of said particulate solid which provides weak adhesion interfaces between itself and said binder material, thereby avoiding excessive puffing and weakening of the resinous structure;

(d) washing said porous mass with a volatile liquid which is a solvent for said particulate solid but is a non-solvent for said binder material, to dissolve said particulate solid from said porous mass to increase the porosity thereof, the partial porosity of said porous mass, caused by activation of the said blowing agent, permitting said volatile liquid to penetrate within said porous mass to facilitate dissolution and removal of said particulate solid;

(e) evaporating said volatile liquid to form a dry microporous solidified mass; and (f) impregnating said microporous solidified mass with a liquid, non-drying ink to produce a transfer element capable of exuding said liquid ink under the effects of applied pressure.

2. Process according to claim 1 in which the composition of step (a) also includes a volatile liquid which is a non-solvent for said binder material and for said blowing agent and for said particular solid, and which is less volatile than said volatile solvent, and said volatile liquid is evaporated after the evaporation of said volatile solvent in step (b) to form a blushed solidified mass, followed by steps (c) through (f).

3. Process according to claim 1 in which the weight ratio of blowing agent to binder material is from about 0.1:1 to about 3:1 and the weight ratio of particulate solid to binder material is from about 1:1 to about 5:1.

4. Process according to claim 1 in which the amount of the particulate solid present in the composition of step (a) is at least about twice as great as the amount of the blowing agent.

5. Process according to claim 1 in which the composition is deposited as a thin coating on a plastic film foundation in step (b), and the foundation is retained as a support for the transfer element.

6. Process according to claim 1 in which the composition is deposited as a thin coating on a casting surface in step (b), and is subsequently removed from the casting surface for use as a self-supporting transfer element.

7. Process according to claim 1 in which the synthetic film-forming binder material is selected from the group consisting of vinyl resins, nylon, and cellulosic film-forming polymers.

8. Pressure-sensitive, ink-releasing transfer element produced according to claim 1.

9. Pressure-sensitive, ink-releasing transfer element produced according to claim 2.

10. Pressure-sensitive, ink-releasing transfer element produced according to claim 3.

* * * * *